United States Patent [19]

Kita et al.

[11] Patent Number: 5,014,317

[45] Date of Patent: May 7, 1991

[54] RECORDING/REPRODUCING APPARATUS WITH VOICE RECOGNITION FUNCTION

[75] Inventors: Kazunori Kita, Oome; Eiji Nakazawa, Akishima, both of Japan

[73] Assignee: Casio Computer Co., Ltd., Tokyo, Japan

[21] Appl. No.: 485,755

[22] Filed: Feb. 26, 1990

Related U.S. Application Data

[63] Continuation of Ser. No. 226,943, Aug. 1, 1988, abandoned.

[30] Foreign Application Priority Data

Aug. 7, 1987 [JP] Japan ..... 62-120511
Jun. 22, 1988 [JP] Japan ..... 63-154100

[51] Int. Cl.[5] ..... G10L 7/08
[52] U.S. Cl. ..... 381/43
[58] Field of Search ..... 381/41-46, 381/51-53, 110; 364/513.5; 368/63, 72-74

[56] References Cited

U.S. PATENT DOCUMENTS 4,081,607 3/1978 Vitols ..... 381/43
4,117,542 9/1978 Klausner et al. ..... 364/900
4,276,541 6/1981 Inoue et al. ..... 340/146.3 SY
4,391,530 7/1983 Wakabayashi ..... 368/63
4,405,241 9/1983 Aihara et al. ..... 364/200
4,412,098 10/1983 An ..... 381/43
4,461,023 7/1984 Katayama ..... 381/43
4,509,133 4/1985 Monbaron et al. ..... 381/43
4,532,648 7/1985 Noso et al. ..... 381/41
4,596,031 6/1986 Hakaridani et al. ..... 381/43
4,635,286 1/1987 Bui et al. ..... 381/43
4,751,668 6/1988 Aihara et al. ..... 368/63

*Primary Examiner*—Gary V. Harkcom
*Assistant Examiner*—John A. Merecki
*Attorney, Agent, or Firm*—Frishauf, Holtz, Goodman & Woodward

[57] ABSTRACT

A recording and reproducing apparatus wherein an externally input voice stating an alarm time such as month, day and time, together with an associated message, is converted into voice data for storage in a voice data memory. Only that portion of the voice indicating the alarm time is recognized by a voice alarm time recognition circuit and is also stored in an alarm time data memory as an alarm time. When the alarm time is reached, the corresponding voice data stored in the voice data memory is read out and audibly reproduced so as to sound the alarm time and the associated message.

7 Claims, 6 Drawing Sheets

RECORDING/REPRODUCING APPARATUS WITH VOICE RECOGNITION FUNCTION

This application is a continuation of application Ser. No. 07/226,943, Aug. 1, 1988, now abandoned.

BACKGROUND OF THE INVENTION

The present invention relates to a recording/reproducing apparatus having a voice recognition function, for controlling a recording operation of an externally input voice, and a reproducing operation of the recorded voice.

DESCRIPTION OF THE PRIOR ART

In an electronic appliance having a recording function, a magnetic recording tape and a disc are employed for recording voices, music and so on. Recently, a semiconductor memory such as a random access memory (RAM) is utilized as a recording medium for recording voice data and music data encoded in a digital form. Such a semi-conductor recording medium built in a small electronic appliance is known, for instance, from Wakabayashi et. al. U.S. Pat. No. 4,391,530, issued July 5, 1983. In this U.S. Patent is illustrated an electronic timepiece in which a voice externally input is converted into voice data to be stored in a semi-conductor memory, and when it comes to an alarm time, the voice data stored in the semi-conductor memory are read out for reproducing the voice.

Another electronic timepiece is disclosed in Aihara et. al. U.S. Pat. No. 4,405,241, issued Sept. 20, 1983, which is provided with an alarm time memory portion for storing a number of alarm times and a semi-conductor memory comprising RAMs, each corresponding to the alarm time memory portion. At an alarm time, the voice data is read out from the semi-conductor memory corresponding to the alarm time for reproducing the voice. In the techniques disclosed in both the U.S. Patents, information such as schedules, comments, messages, and the like to be read out at predetermined alarm times are stored before hand in the semiconductor memory and the informations is automatically reproduced at the alarm times. In the technique illustrated in Inoue Tomohiro et. al. U.S. Pat. No, 4,276,541, schedules, comments, messages and the like must be stored by means of a key-input operation using alphanumeric keys for displaying them at the alarm times. The techniques disclosed in the above U.S. Pat. Nos. 4,391,530 and 4,405,241 have a merit, as they only require an extremely simple operation rather than a time consuming operation as needed in the Inoue Patent. However, the electronic timepieces according to U.S. Pat. Nos. 4,391,530 and 4,405,241 require a key operation to set alarm times. For example, when a number of alarm times are set as in the electronic timepiece of U.S. Pat. No. 4,405,241, it is a disadvantage that the troublesome operation is required for setting alarm times.

Apparatus, called a small sized data-bank device, have been recently known which are arranged to store a number of names and phone numbers in electronic timepieces or small, portable electronic calculators and to selectively display names or phone numbers. This technique is described, for instance, in Aihara U.S. Pat. No. 4,751,668 and Judah Klausner U.S. Pat. No. 4,117,542.

These data-bank devices are arranged to store names and phone numbers in RAM by a key-input operation.

Even in these data-bank devices, an input/output operation by recording/reproducing a voice instead of by a key manipulation permits a storing/reproducing of names and phone numbers with an extremely simple manipulation. However, these data-bank devices still have a problem that the store by recording voice makes it difficult to immediately select and reproduce a required name and phone number out of a number of the stored names and phone numbers.

SUMMARY OF THE INVENTION

The present invention is intended to overcome disadvantages of the above mentioned art, and its object is to provide a recording/reproducing apparatus having a voice recognition function which is capable of storing in a memory a number of information items (data) as voice data and instantly reproducing an arbitrary voice data from a number of the information items.

To achieve the above object, according to the present invention, there is provided a recording/reproducing apparatus with a voice recognition function comprising:

voice input means for receiving external voices;

voice converter means for converting the voice to voice data;

voice data storage means for storing said voice data;

recognized data storage means for recognizing a predetermined voice among the voices input to said voice input means and for storing thus recognized data;

data output means for outputting the same data as that being stored in said recognized data storage means;

read control means for reading out voice data from said voice data storage means when said data output means outputs said same data;

announcing means for converting the voice data read out by said read control means to a voice signal to produce the voice thereof.

BRIEF DESCRIPTION OF THE DRAWINGS

This as well as other objects and advantages of the present invention will be better appreciated upon reading the following detailed description of the presently preferred exemplary embodiments in conjunction with the accompanying drawings, in which.

DETAILED DESCRIPTION OF THE PREFERRED EMBODIMENT FIRST EMBODIMENT

FIGS. 1A to 1D are block diagrams showing a wrist watch circuit according to the present invention (the first embodiment). FIG. 2 is a view showing the relative arrangement of the block diagrams of FIGS. 1A to 1D.

Figure 1A:
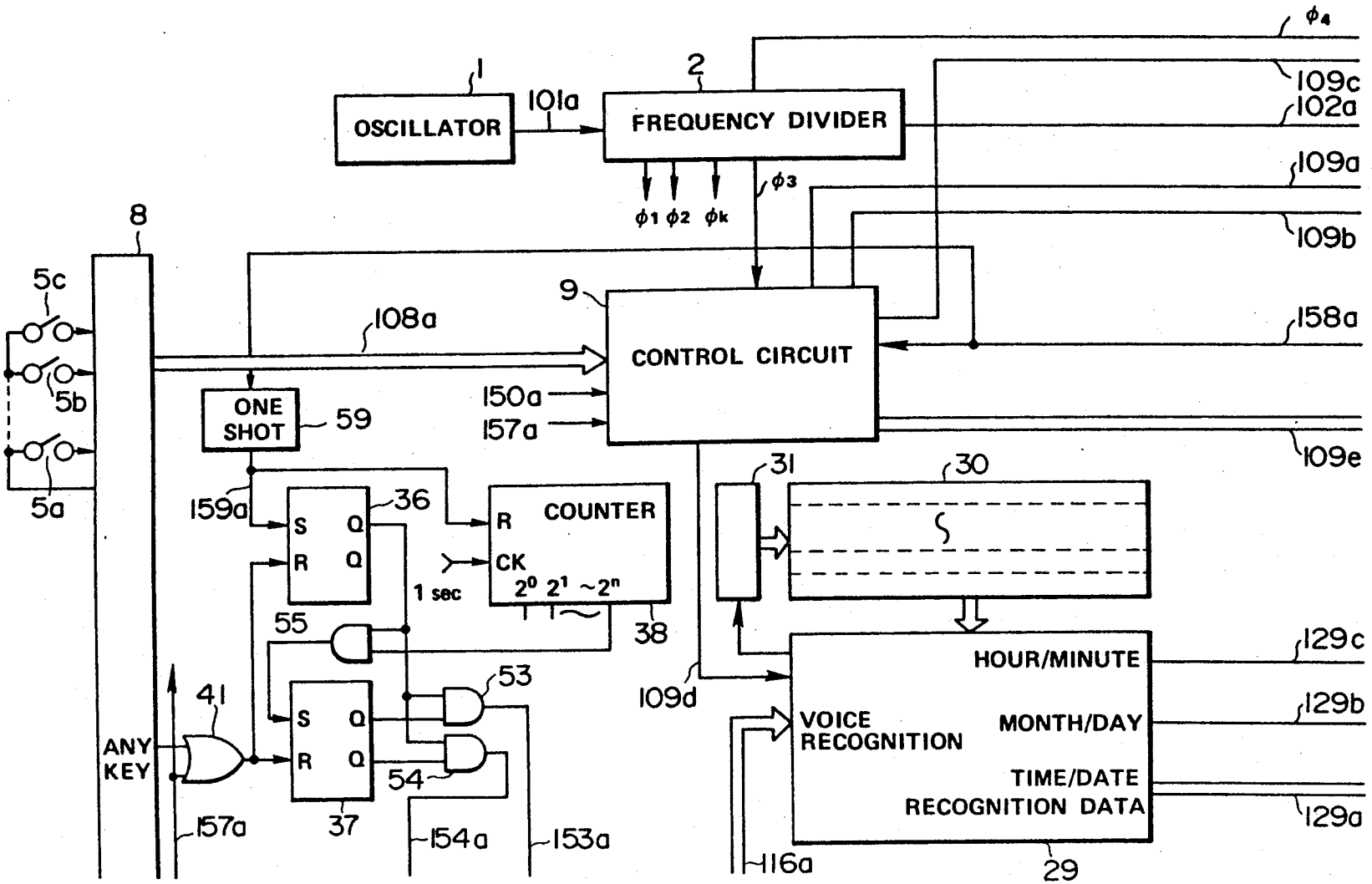
FIGS. 1A to 1D are circuit diagrams of the first embodiment of the present invention.

In FIG. 1A, an oscillation signal 10*a* generated by an oscillator 1 is supplied to a frequency divider 2. The frequency divider 2 divides the oscillation signal 10*a* to produce a signal 102*a* with a period of one second, which is supplied to a time counting circuit 3 shown in FIG. 1B. The time counting circuit 3 counts the signal 102*a* to obtain time data 103*b* such as "hour", "minute" and "second" data. A data counting circuit 4 counts a signal 103*a* with a period of one day which is supplied from the time counting circuit 3 and produces calendar data 104*a* such as "year", "month" and "date" data. The time data 103b and the calendar data 104a are transferred to a display data selection circuit 10 and further to a display device 12 for a digital display through a display driving circuit 11. The display device 12 comprises, for example, a liquid crystal display device and is provided with a digital display portion 12a for displaying a current time data and alarm time data stored in a RAM 34 which will be described hereinafter, a digital display portion 12b for displaying a current date and alarm date data stored in the RAM 34 and a display portion 12c for displaying a leading address of the voice data stored in a RAM 17 which will be described hereinafter.

Figure 1B:
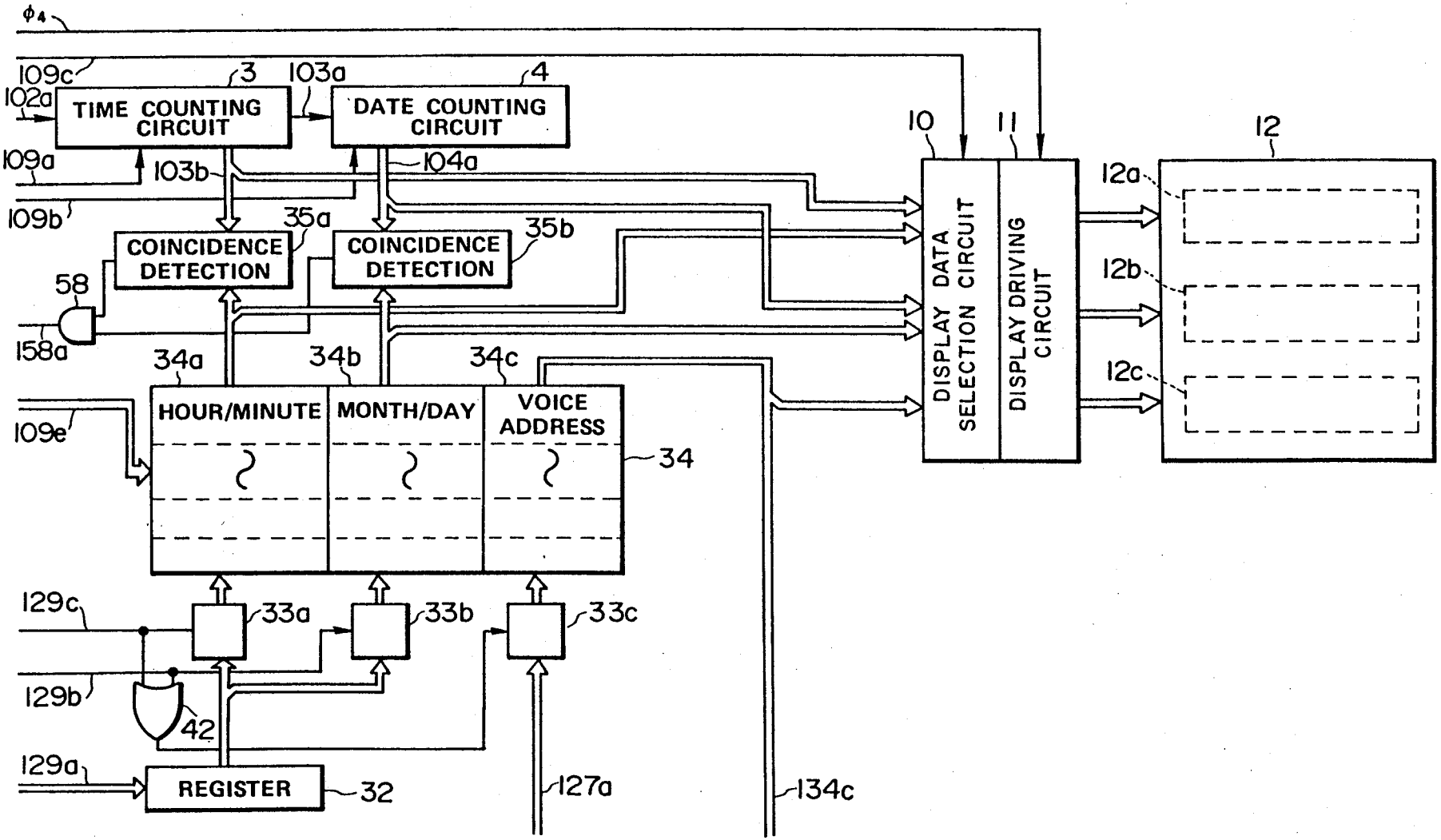
Figure 1C:
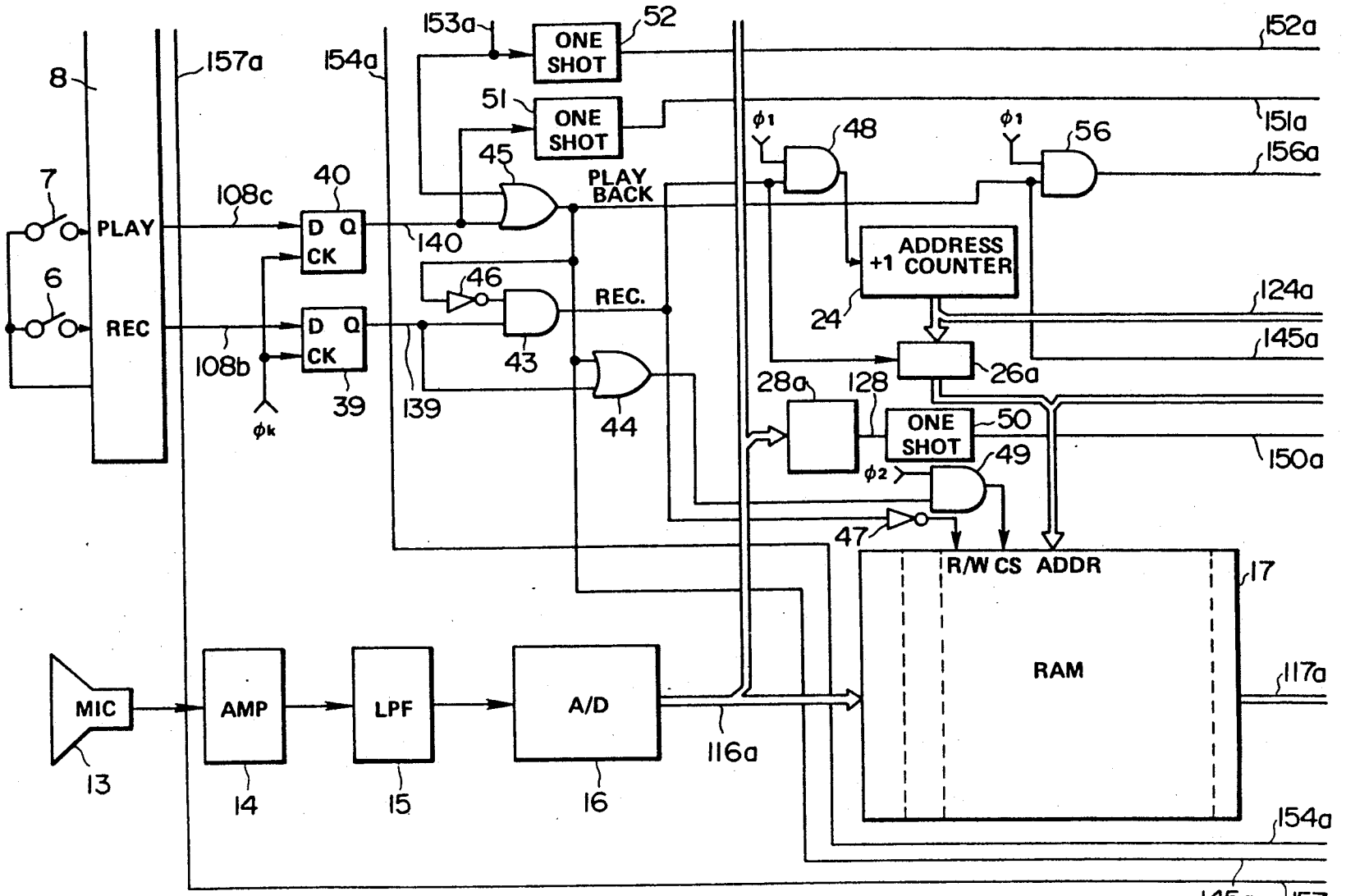
Figure 2:
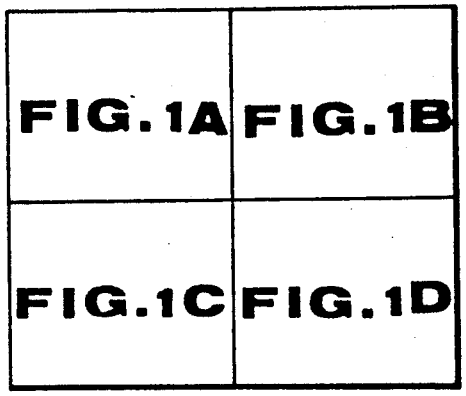
FIG. 2 shows a relationship between the circuit diagrams illustrated in FIGS. 1A to 1D.

The frequency divider 2 in FIG. 1A divides the reference frequency signal 10a generated by the oscillator 1 to generate clock signals, $F_1$, $F_2$ and $F_k$ of a pre-determined frequency which are supplied to other circuits as control clock signals. The frequency divider 2 further generates a clock signal $F_3$ to be fed to a control circuit 9 and a clock signal $F_4$ for driving the display driving circuit 11 in FIG. 1B. The above control circuit 9 to be described in detail has a ROM for storing micro programs, a counter and an operation circuit, and is arranged to supply various control signals to circuits. Manipulation switches 5a, 5b and 5c in FIG. 1A and manipulation switches 6, 7 in FIG. 1C are provided at predetermined positions on the case of a wrist watch (not shown). Output signals from these manipulation switches are input to a switch input circuit 8. The manipulation switch 5a is adapted for selecting one of a timepiece mode and a recording/reproducing mode, switch 5b for correcting the time and switch 5c for correcting the calendar of "year", "month" and "date". Input signals from the switches 5a, 5b and 5c are supplied to the switch input circuit 8 and a signal 108a is further input to the control circuit 9. Upon receipt of the signal 108a, the control circuit 9 supplies a time correction signal 109a to the time counting circuit 3 and a calendar correction signal 109b to the date counting circuit 4. The control circuit 9 supplies to the display data selection circuit 10 (FIG. 1B) a data selection signal 109c for selecting the data to be displayed on the display device 12 and when the recording/reproducing mode is selected by an operation of the manipulating switch 5c, the control circuit 9 outputs an operation instruction signal 109d to a voice recognition circuit 29 to be described later.

The control circuit 9 also supplies a control signal 109e including an addressing signal for assigning addresses in RAM 34 to be described later. When it has received a signal 150a in the recording mode to be described later, the control circuit 9 controls to designate respectively one of assignment areas 34a in the RAM 34 for a plurality of alarm hour/minute data (time data), one of assignment areas 34b for a plurality of alarm month/day data (date data), and one of assignment areas 34c for a plurality of voice address data in order to write thereto alarm time data, date data and voice address data. After completion of the recording operation, the control circuit 9 controls to sequentially read out every minute the above alarm time data and date data. Furthermore, when the control circuit 9 has received a signal 158a from an AND gate 58 to be described later (in FIG. 1B), it controls to stop reading out the data, thereby outputting from RAM 34 the voice address data corresponding to the alarm time and the alarm date data, the addresses of which are designated at that time. However, when the control circuit 9 has received a signal 157a to be described later, it controls to start reading out the data again.

In FIG. 1C, the switch 6 serves as a recording switch, and a signal from the switch 6 is coupled to the switch input circuit 8. A signal 108b from the circuit 8 is further transferred to the input terminal D of a flip-flop 39.

The switch 7 serves as a play back switch (a reproducing switch), the output signal of which is transferred to the switch input circuit 8 and further to the input terminal D of a flip-flop 40 through signal 108c. Note that the clock signal $F_k$ is supplied to the clock input terminal ck of the flip-flops 39, 40.

When any of the manipulation switches 5a, 5b and 5c, the recording switch 6 and the play back switch 7 is operated, the switch input circuit 8 is arranged to output a signal, ANY KEY (FIG. 1A) of a high level "1" which is to be fed to the reset input terminals R of flip-flops 36, 37 through an OR gate 41.

In FIG. 1C, a microphone 13, an amplifier 14, a low-pass filter 15 and an A/D (analog to digital) converter 16 constitute a circuit for converting a voice externally supplied into a voice data. The digital voice data 116a output from the A/D converter 16 is coupled to the RAM, a discriminate circuit 28a and a voice recognition circuit 29 in FIG. 1A.

Figure 1D:
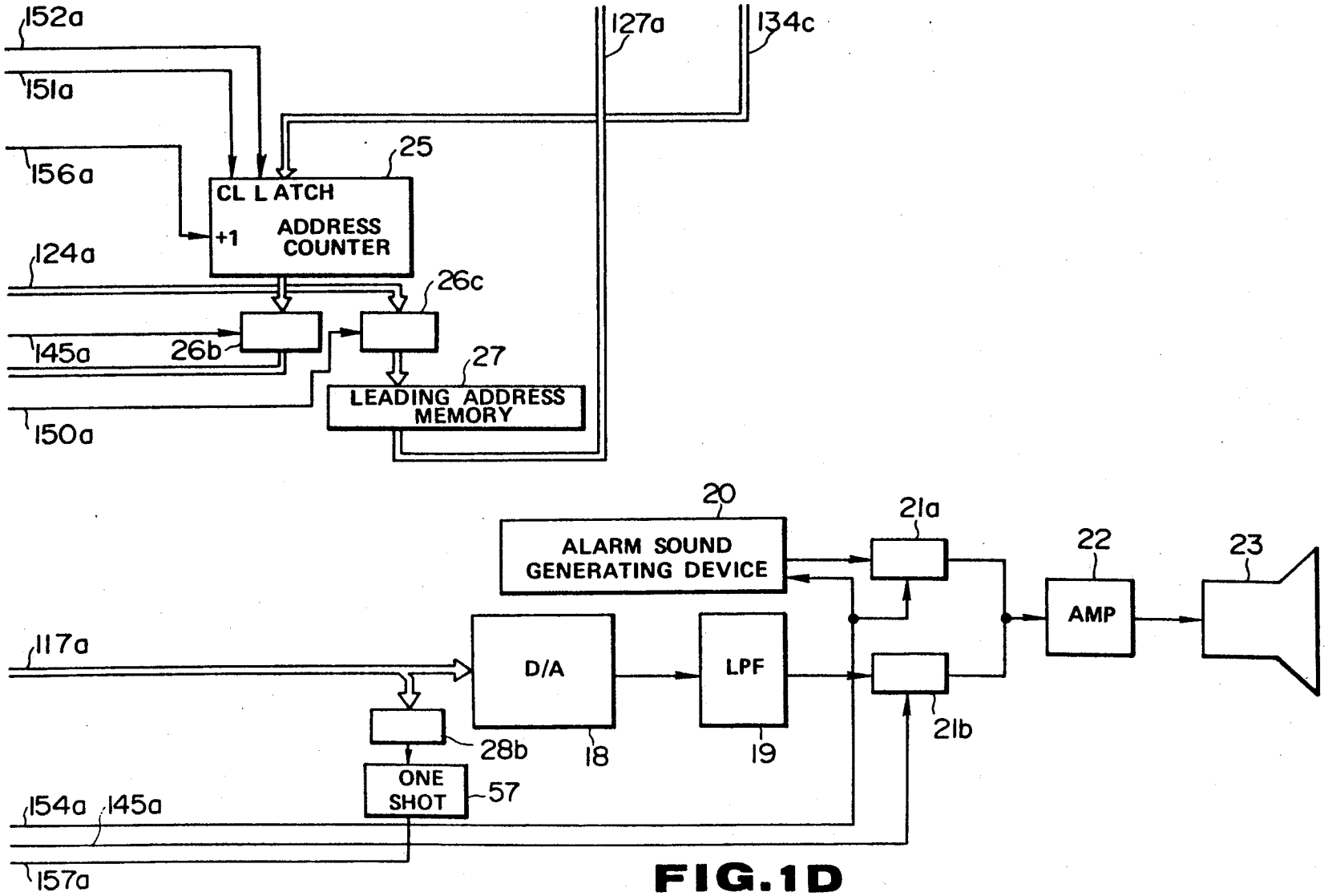

The digital voice data written and stored in the RAM 17 is supplied through a signal 117a to a voice reproducing circuit consisting of a D/A converter, a low-pass filter 19, a transfer gate 21b, an amplifier 22 and a loud speaker 23 as shown in FIG. 1D for the reproduction of voice.

The voice recognition circuit 29 in FIG. 1A serves as a circuit for recognizing voice data of month/day and hour/minute in the digital voice data 116a supplied from the A/D converter 16. Upon recognition of the month/day data, the voice recognition circuit 29 converts the recognized data into a binary digital data and sets it in an identification data register 32 in FIG. 1B through a signal 129a. The circuit 29 outputs a signal 129b to write the month/day data previously set in the identification data register 32 in the month/day area 34b of the RAM 34 through a transfer gate 33b. When the voice recognition circuit 29 has recognized the hour/minute data, it sets the binary digital data corresponding to the above recognized data in the identification data register 32 and at the same time outputs a signal 129c to the transfer gate 33a, thereby writing the above binary digital data in the hour/minute area 34a of RAM 34.

The discriminate circuit 28a in FIG. 1C outputs a signal 128, when it detects that the supplied digital signal 116a keeps blank for a predetermined period of time, for example, for one second or more. Upon receipt of the signal 128, an one-shot pulse generator 50 sends an one-shot pulse signal 150a to a transfer gate 26 in synchronism with the rising edge of the signal 128, thereby causing the address data 124a stored in the address counter 24 of RAM 17 to be pre-set in the leading address memory 27 in FIG. 1D. In FIG. 1B, when the OR gate 42 receives input signals 129c, 129b, it outputs a signal to make the transfer gate 33c open, thereby permitting the address data 127a preset in the leading address memory 27 to be written in the voice address area 34c of RAM 34.

As described above, RAM 34 is capable of storing several sets of combination data consisting of hour/minute, month/day and voice address data. Each data in the combination data is written or read out, when its address is specified by the control circuit 19.

Under control of the control circuit 9, the voice recognition circuit 29 executes its recognition operation of the voice data of hour/minute, month/day in the voice data 116*a* conveyed from the A/D converter 16 by comparing the above voice data 116*a* with the recognition reference pattern data of hour/minute, month/day which are stored in the recognition reference pattern memory 30.

The recognition reference pattern memory 30 includes a voice data pattern data of month such as January, February through December, of date such as first day, second day through 31st day, of hour unit such as one o'clock, two o'clock through twenty four o'clock and of minute unit such as one minute, two minutes through 59 minutes.

The voice recognition circuit 29 supplies a clock signal to an address control circuit 31 of the recognition reference pattern memory 30. The address control circuit 31 sequentially increments address for controlling to sequentially send all of the pattern data in the memory 30 to the voice recognition circuit 29. In this manner, the voice recognition circuit 29 compares the voice data 116*a* from the A/D converter 16 with the reference pattern from the memory 30 to decide if there is month/day, hour/minute data in the voice data 116*a*. If the circuit 29 has detected the month/day, hour/minute data, it forms and sends a binary digital data corresponding to the month/day, hour/minute data and outputs signals 129*b*, 129*c*.

In FIG. 1C, a signal 108*b* in accordance to the manipulation of the recording switch 6 is coupled to a flip-flop 39, a set output signal 139 of which is supplied both to one terminal of AND gate 43 and to OR gate 44. An output of OR gate 45 is transferred to other terminal of the AND gate 43 through an inverter 46. The output of the AND gate 43 is supplied to the read/write control terminal R,$\overline{W}$ (read when "1" and write when "0") of RAM 17 through an inverter 47 and to one terminal of AND gate 48 and further to a transfer gate 26*a* as a control signal for opening gate. The clock signal $F_1$ output from the AND gate 48 is coupled to +1 input terminal of an address counter 24 to be counted. The address counter 24 provides an address data 124*a* for recording (writing) the voice data in RAM 17. The address data 124*a* is supplied to the address-data input terminal ADDR of RAM 17 through a transfer gate 26*a*. At this time, the output signal of OR gate 44 has been supplied to AND gate 49 as a gate control signal, and the clock signal $F_2$ from the frequency divider 2 is coupled to the other terminal of AND gate 49 and further to the CS input terminal of RAM 17 as a chip selecting signal through AND gate 49.

The address data 124*a* in the address counter 24 is set in the leading address memory 27 through the transfer gate 26*c*, as described above. The transfer gate 26*c* is controlled to open by one shot signal from the one-shot pulse generator 50 which receives a discriminating signal 128 from the discriminate circuit 28*a*. The discriminate circuit 28*a* discriminates a continuous blanking state of more than a predetermined period of the voice data 116*a*. Accordingly, the address data is set in the leading address memory 27 after a lapse of a predetermined period of time following the time when writing of the voice data previously written is completed. When the following voice data is written in RAM 17, the address data set in the leading address memory 27 will be set in the voice address area in RAM 34 as the leading address corresponding to the set time, set date of hour/minute, month/day which are recognized at the time by the voice recognition circuit 29.

Meanwhile, a signal 108*c* generated by a manipulation of the play-back switch 7 is coupled to the flip-flop 40. The set output signal 140 of the flip-flop 40 is input to OR gate 45 and to the one-shot pulse generator 51. The one-shot pulse signal 15*a* from the one-shot pulse generator 51 is supplied to the address counter 25 in FIG. 1D as a latch instruction signal. The output signal 153*a* of AND gate 53 in FIG. 1A is coupled to the OR gate 45. The AND gate 53 outputs a signal of level "1", as described later, when the set time data and the set date data set in RAM 34 in FIG. 1B coincide with the time data of the time counting circuit 3 and the date counting circuit F, i.e., when it comes to an alarm time. Thus, the output signal 145*a* of the OR gate 45 is input to AND gate 43 through AND gate 56 and the inverter 46, as well as to the OR gate 44, and is supplied to transfer gates 21*b*, 26*b* in FIG. 1D as the gate control signal. The output signal 153*a* of AND gate 53 is coupled to the one-shot pulse generator 52 and is transferred into a one-shot pulse signal, which is supplied to the address counter 25 as the latch instruction signal 152*a*. The clock signal $F_1$ from the frequency divider 2 is input to the other terminal of the AND gate 56 and the clock signal $F_1$ output from the AND gate 56 is further supplied for counting to the +1 input terminal of the address counter 25. The leading address data read out from the voice address area 34*c* of RAM 34 is latched in the address counter 25 by one shot signal 15*a* or 152*a* from the one shot pulse generator 51 or generator 52 and the address data is counted up every clock signal $F_1$ from the AND gate 56 for addressing RAM 17. That is, the voice data stored in RAM 17 is read out in accordance with the address data from the address counter 25 and is further transferred to the loud speaker 23 for reproducing the voice through D/A converter 18, low-pass filter 19, transfer gate 21*b* and amplifier 22 (FIG. 1D). Note that the voice data read out from RAM 17 is coupled to the discriminate circuit 28*b* for discriminating a predetermined blanking period. Upon detecting the blanking period, the discriminate circuit 28*b* generates a signal 128 of level "1", which is coupled to the one-shot pulse generator 57. Then the one-shot pulse generator 57 provides the one-shot pulse signal 157*a* to OR gate 41 in FIG. 1A.

In FIG. 1B, a plurality of set times, set dates and leading addresses respectively written in hour/minute, month/day and voice address areas of RAM 34 are sent together to the display data selection circuit 10 and further to the display device 12 for the display through the display driving circuit 11 when it is rendered into a recording/play back mode by manipulation of the switch 5*a*, and the signal 109*c* of level "1" from the control circuit 19 is supplied to the selection circuit 10. The above mentioned set time data are also supplied to one terminal of a coincidence detection circuit 35*a* and the set date data to one terminal of a coincidence detection circuit 35*b* respectively for a period of one second sequentially once in a minute under the control of the control circuit 9. Time data from the time counting circuit 3 is supplied to the other terminal of the coincidence detection circuit 35*a* and date data from the date counting circuit 4 to the other terminal of the coincidence detection circuit 35*b*. Both the coincidence detection circuits 35*a*, 35*b* execute the coincidence detection processing of the data supplied to both terminals to provide the coincidence detection signal to the AND gate 58. Accordingly, when coincidence is detected between the time and date data in RAM 34 and the time and date data respectively in the time counting circuit 3 and in the date counting circuit 4, i.e., when it comes to an alarm time, the AND gate 58 generates a signal 158*a* of level "1", which is supplied to the control circuit 9 in FIG. 1A and further to the one-shot pulse generator 59 to generate one-shot pulse signal 159*a*. The one shot pulse signal 159*a* is supplied to the flip-flop 36 for its setting and to the counter 38 for its re-setting. The set output signal of the flip-flop 36 is supplied to one terminal of AND gates 53, 54 and 55. The set output signal of the flip-flop 37 is supplied to the other terminal of the AND gate 53, while the reset output signal of the flip-flop 37 is supplied to the other terminal of AND gate 54. The output signal 153*a* of the AND gate 53 is supplied to OR gate 54 and one-shot pulse generator 52 in FIG. 1C, and the output signal 154*a* of the AND gate 54 is supplied to an alarm generating device 20 in FIG. 1D and to transfer gate 2*a* as a gate opening signal. Note that the transfer gate 2*a* has been supplied with the alarm signal from the alarm generating device 20 and when the transfer gate 2*a* is made open at the alarm time, the transfer gate 21*a* outputs the alarm signal to the loud speaker 23 through the amplifier 22 for producing the alarm sound.

In FIG. 1A, a counter 38 is supplied to its clock input terminal CK with a one second signal from the frequency divider 2 for counting. The AND gate 55 is arranged to receive at its other terminal the count up signal from the MSB (Most Significant Bit) $2^N$ of the counter 38 and to output its output signal to set the flip-flop 37. During a predetermined time interval from the alarm time to the count up of the counter 38. The alarm generating circuit 20 produces the alarm sound. When the counter 38 counts up, the alarm generating circuit 20 stops producing the alarm sound and reads out the data from RAM 17 for the production of voice sound.

VOICE RECORDING OPERATION

An operation for respectively setting alarm time and date in RAM 34 as well as for transferring the input voice from the microphone 13 into the voice data to store it in RAM 17 will be described hereinafter.

For a recording operation, the recording switch 6 is turned "ON". Then, the input signal of the recording switch 6 is conveyed to the switch input circuit 8 and the signal of level "1" is supplied to the input terminal D of the flip-flop 39. While the recording switch is kept "ON", the set output signal 139 of the flip-flop 39 maintains the level "1" and is supplied to AND gate 43 and OR gate 44. At this time, as the output signal of level "1" from the inverter 46 has been input to the other terminal of AND gate 43, the output signal of the AND gate 43 is rendered to "1", Therefore, a write instruction of "0" is input to the read/write control terminal R/w of RAM 17 through the inverter 47 and the transfer gate 26*a* is made open, allowing the AND gate 48 to output the clock signal $F_1$. The clock signal $F_1$ is supplied to the +1 input terminal of the address counter 24 for counting up, so that the address data is transferred to ADDR terminal of RAM 17 through the transfer gate 26*a*. Application of the output signal of OR gate 44 to AND gate 49 permits it to transfer the clock signal $F_2$ to CS terminal of RAM 17 for the chip selection.

Then, month/day and hour/minute as the alarm time and date, and comments or messages are sequentially input by means of recording the voice transmitted from the microphone 13. The A/D converter 16 transfers the voice data to the voice recognition circuit 29. The voice recognition circuit 29 identifies that the voice data includes the date data by comparing the voice data with the reference pattern data from the recognition reference pattern memory 30 and converts the identified date data into a binary digital data to set in the identification data register 32. The binary digital data is pre-set in the month/day data memory 34*b* in RAM 34 through the transfer gate 33*b*. In the similar manner, the hour/minute data is identified by the voice recognition circuit 29 and is converted to the binary digital data to be set in the register 32. The binary digital data of hour/minute is pre-set as the set time in the hour/minute area 34*a* of RAM 34 through the transfer gate 33*a*. At this time, the transfer gate 33*c* is also open, so that the leading address, which is set to "0" at the initial recording, in the leading address memory 27 is written in the voice address area 34*c* of RAM 34 as a pair data of the above set time and set date data. In the meantime, voice data such as the above month/day, hour/minute data and messages are written in RAM 17. When the discriminator 28*a* detects the blanking period of more than one second after completion of writing of the voice data, it supplies the discrimination signal to the one-shot pulse generator 50, which generates the one-shot pulse signal 150*a* and at this time, the address data in the address counter 24 is set in the leading address memory 27. Accordingly, when the following information such as the alarm time and messages is input by recording the voice corresponding to the information, the last address of the message previously input becomes the leading address of the following voice input, which is set in the leading address memory 27.

The above one-shot pulse signal 150*a* is sent to the control circuit 9. Upon receipt of the one-shot pulse signal 150*a* , the control circuit 9 designates the next address area in RAM 34, thereby permitting the another month/day, hour/minute data to be written therein.

Accordingly, when the information such as the following month/day, hour/minute and messages is orally input through the microphone 13, the message data is sequentially written in RAM 17, while month/day, hour/minute data and the leading address are stored in RAM 34.

By orally inputting an alarm time (time and date) and next its message through the microphone 13, the alarm time is automatically set in RAM 34 and then its message is also automatically stored in RAM 17. In this manner, a plurality of alarm times and the messages can be set by an extremely simple operation.

VOICE REPRODUCING OPERATION

After storing the alarm times and the messages respectively in RAM 34 and RAM 17 as described above, the play back switch 7 is manipulated for identifying the stored contents in RAMs 34, 17. When the play back switch 7 is turned "ON" and while it is maintained "ON", the flip-flop 40 generates its set output signal of "1" and then OR gate 45 outputs its output signal of "1".

Accordingly, during this period, the output of AND gate 43 goes to "0" and RAM 17 is supplied with the read instruction at its terminal R,$\overline{w}$. The output of "1" from the OR gate 44 renders RAM 17 to the chip selection. Furthermore, AND gate 56 is made open and the clock signal $F_1$ is transferred to the address counter 25.

Then the address counter 25 supplies the address data to the terminal ADDR of RAM 17 through the transfer gate 26*b* which is kept open. In this way, the message data is read out from RAM 17 and is transferred to the transfer gate 21*b* through the D/A converter 18 and the low-pass filter 19. At this time, the output of "1" from OR gate 45 keeps the transfer gate 45 open and consequently the above mentioned message data is further transferred to the loud speaker 23 through the transfer gate 21*b* and the amplifier 22 for producing sound.

TIME COUNTING OPERATION AND COINCIDENCE DETECTION OPERATION

The oscillator 1, the frequency divider 2, the time counting circuit 3 and date counting circuit 4 perform the normal time counting operation. The time data in the time counting circuit 3 and the date data in the date counting circuit 4 are sent respectively to the display section 12*a* and the display section 12*b* of the display device 12 for displaying hour/minute and month/day. The time data from the time counting circuit 3 is always supplied to the coincidence detection circuit 35*a* and the date data from the date counting circuit 4 to the coincidence detection circuit 35*b*. In accordance with the control signal 109*e* from the control circuit 9, a plurality of hour/minute data in RAM 34 are transferred to the coincidence detection circuit 35*a* and a plurality of the month/day data to the coincidence detection circuit 35*b* sequentially once in a minute with a time interval of one second for the coincidence detection operation. When the coincidence between the time data in the time counting circuit 3 as well as the date data in the date counting circuit 4, and the hour/minute data as well as month/day data from RAM 34 is detected, that is, when the alarm time is reached, the output 158*a* of AND gate 58 rises to "1", which is transferred to the control circuit 9 and to the one-shot pulse generator 59 for generating one-shot pulse signal 159*a*. The signal 159*a* serves to set the flip-flop 36 and to reset the counter 38. The reset output signal "1" from the flip-flop 36 renders the AND gates 53, 54 and 55 open, and the counter 38 begins to count one second signals after its reset.

Until the counter 38 counts up and the signal of the MSB $2^N$ becomes "1", the flip-flop 37 is maintained reset, providing its reset output signal of "1".

During this period, the output signal 154*a* of AND gate 54 keeps its level "1", rendering the transfer gate 2*a* open. Therefore, the alarm signal from the alarm sound generating circuit 20 is transferred to the loud speaker 23 through the transfer gate 2*a* and the amplifier 22 for producing the alarm sound, say, it is informed that the alarm time is reached.

When the counter 38 counts up, AND gate 55 produces its output signal of "1" to make the flip-flop 37 set. This set output signal of "1" causes the AND gate 53 to produce its output 53*a* of level "1". Accordingly, RAM 17 receives the read instruction and RAM 17 is chip selected. The "1" output of OR gate 45 causes AND gate 56 to transfer the clock signal $F_1$ to the address counter 25, which begins a counting operation. The leading address signal 134*c* in RAM corresponding to the hour/minute and month/day data of the above alarm time is read out from RAM 34 and is latched in accordance with the signal 152*a* from the one-shot pulse generator 52. Then, the address counter 25 is caused to begin its counting operation and to transfer the address data to RAM 17 through the transfer gate 26*b*. The voice data corresponding to the above alarm time starts to be read out from RAM 17 and is supplied to the D/A converter 18.

Meanwhile, at this time, the output signal 154*a* of AND gate 54 falls to "0", which makes the transfer gate 2*a* closed to obstruct the alarm signal from the alarm sound generating device 20. That is, at the time when the alarm time is reached, the alarm sound generating device starts generating the alarm sound and maintains generating the alarm sound until the counter 38 counts up and after generating the alarm sound, the device generates the sound corresponding to the voice data read out from RAM 17 in place of the alarm sound. After generating all of the sounds, the discriminator 28*b* detects the blanking data causing the one-shot pulse generator 57 to generate the signal 157*a* for resetting the flip-flops 36, 37. Therefore, the address counter 25 stops its counting operation and also its reading operation of data in RAM 17. When the signal 157*a* is transferred to the control circuit 9, the coincidence detection operation of the alarm time is started again. In this manner, every time when the alarm time stored in RAM 34 coincides with the current time, the corresponding voice data is read out from RAM 17.

Note that in a modification of the present embodiment, the hour/minute, month/day data in RAM 34 are arranged to be sent to the control circuit 9 and the control circuit 9 arranges these data in the order of hour for presetting them in RAM 34 again and every time the alarm time is reached, the hour/minute, month/day data corresponding to the above time can be erased from RAM 34 for the more effective use of the RAM 34. Furthermore, the modification can be so made that the coincidence of the alarm times with the time and date data respectively in the time counting circuit 3 and the date counting circuit 4 can be detected only by detecting the coincidence of the leading alarm time with the data in circuits 3, 4. The alarm time data to be stored in RAM 34 can be composed of not only month/day, hour/minute data but a sole time data such a hour/minute data, a month/day data, and a week day data and/or an arbitrary combination data of the above data.

SECOND EMBODIMENT

Figure 3:
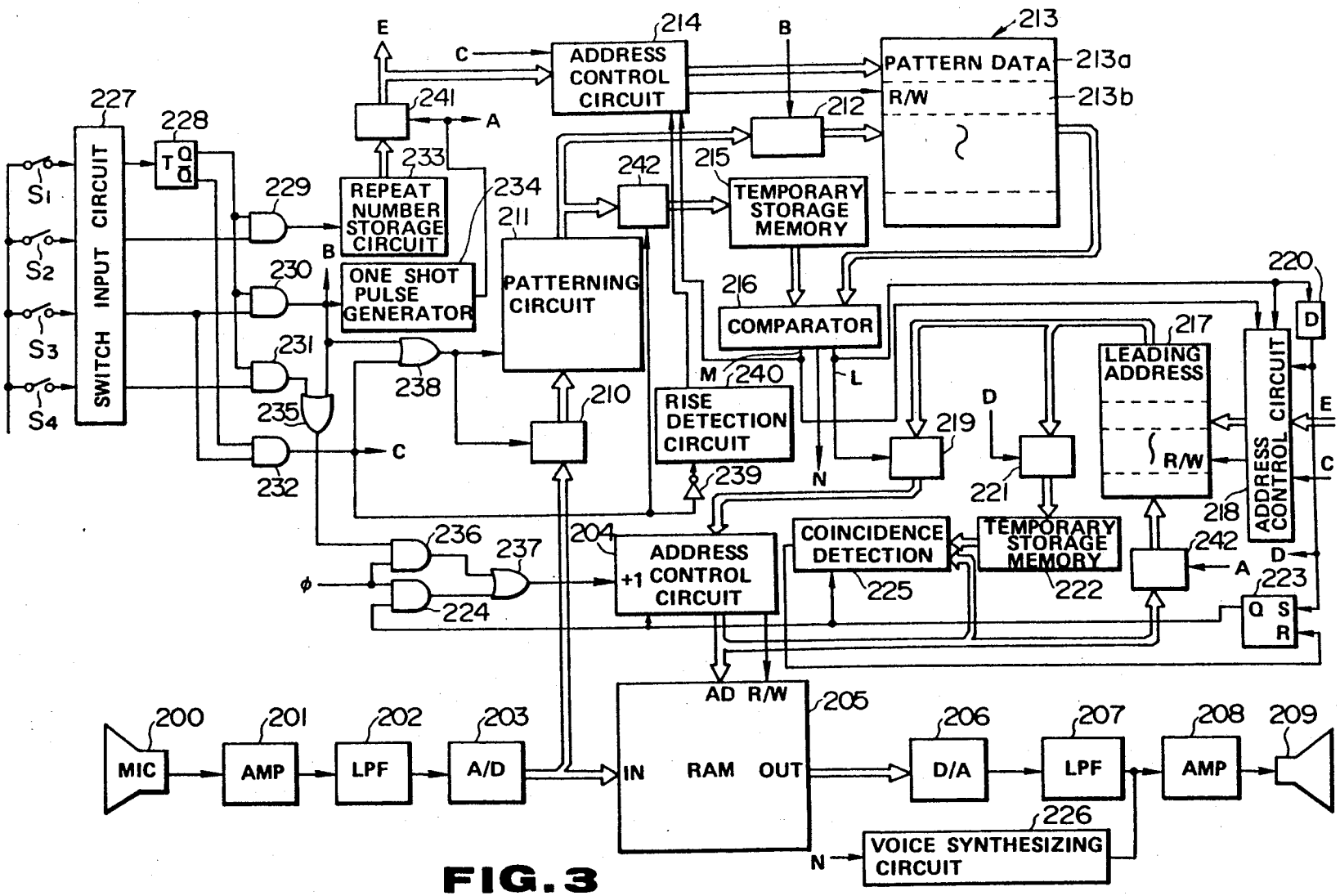
FIG. 3 shows a circuit diagram of the second embodiment of the present invention.

FIG. 3 shows the other embodiment of the recording/reproducing apparatus having the voice recognition function according to the present invention. The present embodiment of the apparatus is capable of storing a number of data such as names and phone numbers, or dates and the schedules on the dates. And the embodiment can reproduce the voice to tell the phone number or the schedule corresponding to the name or the date, when one of the names or the dates is orally input through the microphone.

The microphone 200 serves to convert the externally input voice into an analog voice signal, which is transferred through an amplifier 201 and a low-pass filter 202 to an A/D (analog to digital) converter 203 to be converted into a digital voice data. The digital voice data output from the A/D converter 203 is stored in a voice data storing RAM 205, the address in which is designated by an address control circuit 204. The read and write operation of RAM 205 is also instructed by the address control circuit 204. The voice data stored in RAM 205 is read out under the control of the control circuit 204 and is transferred to a D/A (digital to analog) converter 206 to be converted into an analog voice signal. The analog voice signal is further transferred through a low-pass filter 207 and an amplifier 208 to a loud speaker 209 for generating the voice. The voice data output from the A/D converter 203 is sent to voice data patterning circuit 211 through a transfer gate 210. The voice data patterning circuit 211 extracts and patterns a parameter featuring each voice data. The patterned voice data is sent to a voice pattern storage RAM 213 to be stored in it through a transfer gate 212. The above pattern data is also supplied to a temporary storage memory 215 through a transfer gate 214.

Note that, in this embodiment, the feature of the voice signal which is converted into the digital signal by the A/D converter 203 is patterned, however the analog voice signal output from the low-pass filter 202, which has not been converted into a digital signal, may be transferred to the patterning circuit 211 through the transfer gate 210 for patterning the parameter featuring the voice data by the patterning circuit 211.

The voice pattern storage RAM 213 has storage areas 213*a*, 13*b*, —capable of storing a number of pattern data sent through the transfer gate 212. The address of storage areas of RAM 213 is designated by an address control circuit 214. The operation of read/write of RAM 213 is also instructed by the address control circuit 214. The pattern data stored in the storage areas of RAM 213 is sent to a comparator 216 together with the data stored in the temporary storage memory 215.

The comparator 216 compares the pattern data output from RAM 213 with the data supplied from the temporary storage memory 215 and outputs a coincidence signal L, when both the data almost coincide with each other, outputs a non-coincidence signal M, when both the data do not coincide with each other and outputs a no data signal N, when it receives no pattern data.

The comparator 216 sends the non-coincidence signal M to the address control circuit 214, which, upon receipt of non-coincidence signal M, operates so as to make the pattern storage RAM 213 output the pattern data stored in the following storage area. This non-coincidence signal M is also sent to an address control circuit 218 for a leading address storage RAM 217. The leading address storage RAM 217 sequentially stores the address data of the first voice data of the voice data comprising, for example, names and their phone numbers which are stored in the voice data storage RAM 205. The address control circuit 218 operates so as to increment the designated address of the address storage RAM 217 by one every time it receives the non-coincidence signal M. That is, the following leading address data is assigned an address.

The coincidence signal L from the comparator 216 is supplied to the transfer gate 219 as a gate opening signal and the address control circuit 218 as a signal for reading the leading address data in RAM 218 whose address has been designated. The leading address data read out from RAM 217 under the control of the address control circuit 218 is transferred to the address control circuit 204 to be preset through the transfer gate 219.

The above coincidence signal L is supplied to a delay circuit 220, whose output signal is supplied to the transfer gate 221 as a gate opening signal and is also supplied to the address control circuit 218 for incrementing the address in RAM 217 to read out the leading address data stored in the following storage area in RAM 217. The leading address data read out under the control of the address control circuit 218 is stored in a temporary storage memory 222 through a transfer gate 221.

The output signal from the delay circuit 220 is supplied to the set input terminal S of a flip-flop 223 whose set output signal Q is transferred to AND circuit 224 and also to the address control circuit 204 as an instruction signal for a read operation and further to a coincidence detection circuit 225 as an instruction signal for a coincidence detection operation. The coincidence detection circuit 225 compares the leading address data stored in the temporary storage memory 222 and the address data in RAM 205 which is supplied from the address control circuit 204, and outputs a coincidence signal to the reset terminal of the flip-flop 223 for resetting it when a coincidence between both the data is detected.

The no data signal N output from the comparator 216 is sent to a voice synthesizing circuit 226. Upon receipt of the signal N, the voice synthesizing circuit 226 generates and sends a synthesized voice signal such as a signal expressing "the pertinent data cannot be found" to an amplifier 208.

A switch $S_1$ serves to switch a recording and a play back mode. The signal output from a switch input circuit 227 is sent to a binary flip-flop 228. A Q-output signal of the binary flip-flop 228 is supplied to AND gates 229 to 231, while $\overline{Q}$-output signal is supplied to AND gate 232. A switch $S_2$ serves to count the number of repeats of recording operations. The manipulation signal of the switch $S_2$ is sent to a recording repeat number storage circuit 233 through the AND gate 229. The recording repeat number storage circuit 233 serves to count the signals from the AND gate 229 and to store the counted number data. Switch $S_3$ is manipulated in order to record the voice corresponding to the name or the date to be searched at need, when recording the above names and the phone numbers, the dates and schedules. The switch $S_3$ is also manipulated in a reproducing operation to input the voice corresponding to the name or the date to be searched. A switch $S_4$ is manipulated in a recording operation in order to input the voice of the phone number or the schedule after recording the above name or date.

Hence, a manipulation signal of the switch $S_3$ is supplied to AND gates 230 and 232 through the switch input circuit 227, and a manipulation signal of the switch $S_4$ is supplied to AND gate 231 through the switch input circuit 227.

The output signal of the AND gate 230 is transferred to an one-shot pulse generator 234 and also to an AND gate 236 through an OR gate 235. A clock pulse F from an oscillator (not shown) has been supplied to the AND gate 236 and the above mentioned AND gate 224. The clock pulse F output from AND gates 236 and 224 is supplied through OR gate 237 to the address control circuit 204 of RAM 205 as an address increment signal (+1 signal). The output signal from AND gate 230 is transferred as a gate opening signal to the transfer gate 212 to which the pattern data has been supplied from the voice data patterning circuit 211, and also to the transfer gate 210 for opening it through an OR gate 238 and further to the voice data patterning circuit 211 as an operation instruction signal. The one shot pulse signal from the above one-shot pulse generator 234 is supplied to transfer gates 241 and 242 to open them. The transfer gate 241 has been supplied with the repeat number data from the recording repeat number storage circuit 233 and the repeat number data output from this transfer gate 241 is preset in the address control circuits 214 and 218 as the address signal.

Further, the address data of the address control circuit 204 is transferred to the transfer gate 242 and is stored in RAM 217 as the leading address data.

The output signal from the above AND gate 231 is supplied to OR gate 235. The output signal from AND gate 232 is transferred to OR gate 238 and to the transfer gate 242 for opening it and further to a rise detection circuit 240 through the inverter 239. The rise detection circuit 240 provides an one-shot pulse signal to the address control circuit 214 when the signal from the inverter 239 rises from a low level to a high level. Upon receipt of the above one-shot pulse signal from the circuit 240, the address control circuit 214 begins its operation to read out the pattern data in the area whose address has been designated.

The signal from AND gate 232 is supplied to the address control circuit 214 as an address clear signal.

An operation of an instance of the embodiment of the present invention will be described below, where a number of voice data of names and phone numbers are recorded and/or reproduced.

RECORDING OPERATION

When a number of names and phone numbers are recorded (registered), the switch $S_1$ is manipulated for setting the Q output of the binary flip-flop 228 to a high level ("1" signal). The recording switch $S_3$ is depressed and the first name to be registered is pronounced against the microphone 200 while the switch $S_3$ is kept depressed. The depression of the switch $S_3$ causes the AND gate 230 to output a signal of high level. The one-shot pulse generator 234 outputs an one-shot pulse signal in synchronism with the rising portion of the signal of the AND gate 230 in order to preset the contents ("0", at this time) of the storage circuit 233 in the address control circuits 214 and 218 through the transfer gate 241. That is, the address control circuit 214 designates the first storage area of RAM 213. Accordingly, the address control circuit 218 also designates the storage area of RAM 217. As the one-shot pulse signal A from the one-shot pulse generator 234 makes the transfer gate 242 open, the address data from the address control circuit 204, i.e., the address data which is supplied from the circuit 204 when the switch $S_3$ is depressed, is stored in RAM 217 as the leading address data.

As the signal output from the OR gate 238 maintains the transfer gate 210 open and causes the voice data patterning circuit 211 to operate while the switch $S_3$ is kept depressed, the voice data of the first name is patterned by the voice data patterning circuit 211 and is stored in the first storage area 213*a* of RAM 213 through the transfer gate 212 which is made open by the output signal from the AND gate 230. As the output signal of AND gate 230 is supplied to AND gate 236 through OR gate 235, the clock pulse signal F output from AND gate 236 is transferred to the address control circuit 204 through OR gate 237 and as the result the voice data of the first name is stored in RAM 205.

After the completion of the voice input operation of the name in this manner, the phone number corresponding to the above name is spoken before the microphone 200 to input the phone number, while the switch $S_4$ is kept depressed. As the manipulation signal of the switch $S_4$ is transferred to AND gate 236 through the AND gate 231 and OR gate 235, in the same manner as the above name, the voice data of the phone number is stored in RAM 205 following the name data.

After the completion of registration of the name and the phone number of one person, in order to input the name and the phone number of the second person, the switch $S_2$ is manipulated at first to increment the contents of the recording repeat number storage circuit 233. Then the switch $S_3$ is depressed and the name of the second person is input in voice, the content of the storage circuit 233 is preset in the address control circuits 214 and 218 in synchronism with the rising edge of the manipulation signal of the switch $S_3$. In the pattern data storage RAM 213, the address of the storage area following the storage area where the pattern data of the first name has been stored is designated by the address control circuit 214 and the pattern data of the name of the second person transferred from the voice data patterning circuit 211 is stored therein. In the leading address storage RAM 17, the address control circuit 218 designates the storage area following the storage area where the leading address data of the name of the first person has been stored, so that the leading address data of the name of the second person sent through the transfer gate 242 is stored therein.

After the completion of the voice input of the name of the second person, the phone number corresponding to the name of the second person is input by pronouncing of the above phone number against the microphone, while the switch $S_4$ is kept depressed. The voice data obtained by the voice input is stored in RAM 205 following the second name data. Thereafter, the data of the third and later can be registered by the manipulation of switches $S_2$, $S_3$ and $S_4$ in the similar manner. As the result, the voice data of all names and phone numbers are stored in RAM 205, the pattern data of each name are stored in RAM 213 and the leading address data of each of the name data stored in RAM 205 are stored in RAM 217.

DETECTION OPERATION

In order to detect and produce the sound of a desired name and its phone number out of the names and phone numbers registered as described above, the following manipulation may be executed.

The switch $S_1$ is manipulated to cause the binary flip-flop 228 to output its Q-output of a high level. Then, the voice of the desired name is input through the microphone 200 while the switch $S_3$ is kept depressed. As the manipulation of the switch $S_3$ causes AND gate 232 to provide its output signal to the transfer gate 210 and the voice data patterning circuit 211 through OR gate 238, the voice data of the desired name input from the microphone 200 is patterned and is transferred to the temporary storage memory 215 to be stored therein through the transfer gate 242 which is opened by the output signal of AND gate 232.

The output signal of AND gate 232 clears the address of the address control circuits 214 and 218 to initialize it and causes to designate the addresses of the pattern data and the leading address data of the first name.

After completion of the voice input of the desired name when the switch $S_3$ is released to be turned off, the output signal of the inverter 239 changes from a low level to a high level so that the one-shot signal from the rise detection circuit 240 is supplied to the address control circuit 214. Upon receipt of the above mentioned one-shot pulse signal, the address control circuit 214 reads out the pattern data stored in the first storage area 213*a* of RAM 213 whose address is designated by the initializing process. The pattern data read out from RAM 213 is transferred to the comparator 216. The comparator 216 determines if the above pattern data is identical with the pattern data of the desired name stored in the temporary storage memory 215. If the comparator 216 decides both the data do not coincide with each other, it outputs the non-coincidence signal M to renew the addressing of both RAMs 213 and 217. The pattern data and the leading address data of the name stored in the following storage areas are designated and the pattern data in the renewed storage area is sent to the comparator 216 to be compared with the pattern data in the temporary storage memory 215.

In this manner, the pattern data stored in each storage area of RAM 213 is sequentially compared with the pattern data in the memory 215. When the comparison of all data has been finished and no pattern data to be subjected to comparison is left, the comparator 216 outputs the no data signal N and the voice synthesizing circuit 226 provides the voice signal expressing "there is no corresponding data", which is announced through the speaker 209.

While, when, as the result of the above comparison, the comparator 216 decides that both the pattern data in RAM 213 and in the memory 215 almost coincide with each other, it outputs the coincidence signal L to RAM 217. The RAM 217 supplies the leading address data of the name through the transfer gate 219 to the address control circuit 204 to be preset therein.

Thereafter, upon receipt of the output of the delay circuit 220, RAM 217 provides and transfers the leading address data of the name following the desired name through the transfer gate 221 to the temporary storage memory 222 to be preset therein. At the same time, the output signal of the delay circuit 220 sets the flip-flop 223 and as the clock pulse signal F is output from AND gate 224, the address control circuit 204 renews sequentially the contents from the leading address of the desired name which has been preset in it.

Thereby, the voice data of the above mentioned desired name and of the corresponding phone number are sequentially read out to be fed to the loud speaker 209 for producing the sound of the name and phone number.

When the address data of the voice data of the next name is supplied from the address control circuit 204 after the producing of the sound of the desired name and its phone number the comparator 225 outputs the coincidence signal to reset the flip-flop 223, thereby finalizing the read operation of RAM 205.

In the above mentioned embodiments, a number of names and phone numbers are recorded and it is easily possible to get the phone number only by inputting the voice of the name through the microphone.

Note that the data to be recorded are not limited to the names and the phone numbers as in the present embodiment but any data such as names and phone numbers, dates and schedules, and also any combination of reference data and their corresponding referenced data can be used as data to be recorded in the apparatus of the present invention.

The embodiment shown in FIG. 3 is not provided with any optical display means but the following display means can be applicable to the apparatus according to the present invention:

a. An indicating means which receives the Q and Q output signals of the binary flip-flop 228, for indicating that each of the received signals is of a high level. This indicating means indicates whether the apparatus is set in a recording or play-back mode.

b. A digital display means for displaying the contents of the recording repeat number storage circuit 233, which indicates the numbers of data stored in RAM 205.

c. An indicating means indicating the total memory capacity and the recorded memory capacity or the unrecorded memory capacity.

Further, the comparator in the embodiment in FIG. 3 can be arranged so as to output the coincidence signal, when it decides that for example, 80% and more of both data from the memory 215 and RAM 213 are identical, while the comparator 216 is constructed to output the coincidence signal L only when both the data completely coincide with each other.

Sometimes one reference data has a plurality of different referenced data. For example, a plurality of the voice data of different phone numbers may be stored for the same name. In this case, it is convenient to make the apparatus to produce the voice of all the phone numbers corresponding to the same name.

To obtain the above effect, the apparatus may be so modified that the output signal of the coincidence detection circuit 225 is transferred to the address control circuit 214, and the pattern data in the following storage area in RAM 213 is read out to be sent to the comparator 216, thereby all of the name data stored being compared for producing the voices of all name data of coincidence.

Furthermore, in the above mentioned embodiments, RAMs 205, 213, 217 and each memory are separately provided but these memories can be united into one RAM. And the above mentioned operations can be executed by means of a ROM which stores a micro-program of operation, RAMs and CPUs.

While, in the above mentioned embodiments, the voice data of both names and phone numbers are stored in RAM 205, and the above voice data are reproduced in a play-back mode, but only the phone number data may be recorded and reproduced to obtain the same effect.

What we claim is:

1. A recording and reproducing apparatus, comprising:

time counting means for counting a reference signal to obtain present time data;

voice data output means for receiving an externally supplied voice schedule which includes an alarm time and message, and for outputting voice schedule data including voice alarm time data and voice message data;

voice data storage means coupled to said voice data output means for storing said voice schedule data including the voice alarm time data and voice message data;

address data output means coupled to said voice data storage means for supplying address data to said voice data storage means;

leading address data storage means coupled to said address data output means for storing first address data of the voice schedule data including the voice alarm time data and voice message data stored in said voice data storage means;

voice alarm time recognition means for receiving the voice schedule data output from said voice data output means and recognizing the voice alarm time data included in said voice schedule data;

alarm time data storage means for storing numerical alarm time data corresponding to the voice alarm time data recognized by said voice alarm time recognition means;

coincidence detection means for detecting a coincidence between the numerical alarm time data stored in said alarm time data storage means and the present time data obtained by said time counting means;

reading out control means for transmitting, when a coincidence has been detected by said coincidence detection means, the first address data of the voice schedule data including the voice alarm time data and voice message data, stored in said leading address data storage means to said address data output means, and for reading out the stored voice schedule data including the voice alarm time data and voice message data from said voice data storage means; and voice reproducing means for audibly reproducing the voice schedule data including the voice alarm time data and voice message data which are read out from said voice data storage means by said reading out control means.

2. A recording and reproducing apparatus according to claim 1, wherein said voice data storage means comprises a semiconductor memory.

3. A recording and reproducing apparatus according to claim 1, wherein said voice alarm time recognition means comprises reference pattern storage means for storing reference pattern data including at least one of time, date and day of the week, and a comparator for comparing reference pattern data supplied from said reference pattern storage means with the voice schedule data outputted from said voice data output means.

4. A recording and reproducing apparatus according to claim 1, including:

first display means for displaying the present time data obtained by said time counting means; and second display means for displaying the numerical alarm time data stored in said alarm time data storage means.

5. A recording and reproducing apparatus, comprising:

voice data output means for receiving an externally supplied voice which includes a name and a telephone number, and for outputting voice data including voice name data and voice telephone number data;

voice data storage means coupled to said voice data output means for storing the voice data including the voice name data and the voice telephone number data;

address data output means coupled to said voice data storage means for supplying address data to said voice data storage means;

leading address data storage means coupled to said address data output means for storing first address data of the voice data including the name data and the telephone number data stored in said voice data storage means;

patterning means coupled to said voice data output means for converting at least the voice name data into predefined pattern data, said voice name data being included in the voice data output from said voice data output means;

pattern data storage means for storing pattern data converted by said patterning means;

search operation switch means;

coincidence detection means for detecting a coincidence between the pattern data stored in said pattern data storage means and the pattern data supplied through said patterning means from said voice data output means when said search operation switch means is operated;

reading out control means for transmitting, when the coincidence has been detected by said coincidence detection means, the first address data of the voice data including the voice name data and the voice telephone number data, stored in said leading address data storage means to said address data output means, and for reading out the stored voice data including the voice name data and the voice telephone number data from said voice data storage means; and voice reproducing means for audibly sounding the voice data including the voice name data and the voice telephone number data which are read out from said voice data storage means by said reading out control means.

6. A recording and reproducing apparatus according to claim 5, wherein said pattern data storage means has storage areas capable of storing a number of pattern data obtained by said patterning means.

7. A recording and reproducing apparatus according to claim 5, wherein said address storage means has storage areas for storing a plurality of the address data.

* * * * *